US009258639B2

(12) United States Patent
Choi et al.

(10) Patent No.: US 9,258,639 B2
(45) Date of Patent: Feb. 9, 2016

(54) METHOD AND APPARATUS FOR CREATING PERSONAL SOUND ZONE

(75) Inventors: Jung Woo Choi, Hwaseong-si (KR); Young Tae Kim, Seongnam-si (KR); Sang Chul Ko, Seoul (KR)

(73) Assignee: SAMSUNG ELECTRONICS CO, LTD., Suwon-Si (KR)

( * ) Notice: Subject to any disclaimer, the term of this patent is extended or adjusted under 35 U.S.C. 154(b) by 768 days.

(21) Appl. No.: 13/137,558

(22) Filed: Aug. 25, 2011

(65) Prior Publication Data

US 2012/0163636 A1 Jun. 28, 2012

(30) Foreign Application Priority Data

Dec. 22, 2010 (KR) ..... 10-2010-0132090

(51) Int. Cl.
*H04R 1/40* (2006.01)
*H04R 3/12* (2006.01)
*H04S 7/00* (2006.01)

(52) U.S. Cl.
CPC ..... *H04R 1/403* (2013.01); *H04R 3/12* (2013.01); *H04S 7/30* (2013.01); *H04R 2201/401* (2013.01); *H04R 2499/11* (2013.01)

(58) Field of Classification Search
CPC ..... H04R 1/24; H04R 1/26; H04R 1/227; H04R 1/403; H04R 3/12; H04R 5/02; H04R 9/063
USPC ..... 381/89, 182
See application file for complete search history.

(56) References Cited

U.S. PATENT DOCUMENTS

| | | | | |
|---|---|---|---|---|
| 7,068,800 | B2 | 6/2006 | Matsuo | |
| 7,577,260 | B1 * | 8/2009 | Hooley et al. | 381/77 |
| 7,606,377 | B2 * | 10/2009 | Melanson | 381/97 |
| 8,135,143 | B2 * | 3/2012 | Ishibashi et al. | 381/92 |
| 8,189,828 | B2 * | 5/2012 | Takumai | 381/310 |
| 8,223,992 | B2 * | 7/2012 | Suzuki et al. | 381/97 |
| 8,243,950 | B2 * | 8/2012 | Tanaka et al. | 381/92 |
| 8,351,616 | B1 * | 1/2013 | Graber | 381/89 |
| 8,675,899 | B2 * | 3/2014 | Jung | 381/307 |
| 2004/0151325 | A1 | 8/2004 | Hooley et al. | |
| 2006/0126878 | A1 * | 6/2006 | Takumai et al. | 381/335 |
| 2006/0204022 | A1 | 9/2006 | Hooley et al. | |

(Continued)

FOREIGN PATENT DOCUMENTS

| | | |
|---|---|---|
| JP | 2007-158636 | 6/2007 |
| KR | 10-0788702 | 12/2007 |
| KR | 10-2009-0066090 | 6/2009 |

OTHER PUBLICATIONS

L. E. Kinsler, A. R. Frey, A. B. Coppens, J. V. Sanders, "Fundamentals of Acoustics", 4th edition, John Wiley & Sons, Dec. 30, 1999, p. 199.

*Primary Examiner* — Simon Sing
(74) *Attorney, Agent, or Firm* — Staas & Halsey LLP

(57) ABSTRACT

An apparatus and method for creating a personal sound zone are provided. The personal sound zone creating apparatus increases directivity in a horizontal direction by including a broadside array adapted to generate a sound beam perpendicularly to an arrangement of an array constituted by at least three transducers in a personal audio device. Also, the personal sound zone creating apparatus controls back radiation by including an end-fire array by arranging at least two arrays.

16 Claims, 13 Drawing Sheets

(56) References Cited

U.S. PATENT DOCUMENTS

2006/0255993 A1* 11/2006 Miki et al. ..... 341/143
2007/0019816 A1* 1/2007 Konagai ..... 381/59
2007/0030977 A1 2/2007 Konagai
2007/0081680 A1* 4/2007 Yen ..... 381/182
2007/0169555 A1* 7/2007 Gao et al. ..... 73/620
2008/0159566 A1* 7/2008 Konagai et al. ..... 381/111
2009/0087000 A1* 4/2009 Ko ..... 381/182
2009/0238372 A1* 9/2009 Hsu ..... 381/61

* cited by examiner

METHOD AND APPARATUS FOR CREATING PERSONAL SOUND ZONE

CROSS-REFERENCE TO RELATED APPLICATION

This application claims the benefit of Korean Patent Application No. 10-2010-0132090, filed on Dec. 22, 2010, in the Korean Intellectual Property Office, the disclosure of which is incorporated herein by reference.

BACKGROUND

1. Field

Example embodiments of the following description relate to a method and apparatus for creating a personal sound zone.

2. Description of the Related Art

A technology for creating a personal sound zone enables delivery of a sound to only a designated listener without dedicated devices such as an earphone or a headset, without inducing noise to other people around the listener. Directivity of a sound generated by driving a plurality of sound transducers may be used to create the personal sound zone. However, when sending a sound to, or collecting a sound from a specific zone such as the personal sound zone through arrays of the sound transducers, the sound is able to be dispersed to other zones in a low frequency band. Especially in a small personal electronic device such as a mobile device, creation of the personal sound zone is more difficult because of a limited array size and a limited number of installable transducers.

SUMMARY

The foregoing and/or other aspects are achieved by providing an apparatus for creating a personal sound zone, the apparatus including an array unit configured to comprise at least two arrays arranged in a direction of a sound beam, the at least two arrays each comprising at least three transducers arranged perpendicularly to the direction of the sound beam; and a control signal generation unit configured to generate control signals for the at least two arrays such that the array unit generates the sound beam perpendicularly to the at least three transducers.

Middle transducers among the at least three transducers of the at least two arrays may be coaxially aligned. Intervals among the at least three transducers of the at least two arrays may be uniform.

Intervals among the at least three transducers of any one of the at least two arrays may be different from intervals among the at least three transducers of another array.

The control signal generation unit may generate control signals in which a phase of middle transducers among the at least three transducers of the at least two arrays is a phase of side transducers disposed on the left and the right of the middle transducers.

The control signal generation unit may generate control signals such that control signals related to middle transducers among the at least three transducers of the at least two arrays have a different gain from control signals related to side transducers disposed on the left and the right of the middle transducers.

The control signal generation unit may generate control signals having the same gain and the same phase with respect to transducers disposed at symmetrical positions among the at least three transducers included in each of the at least two arrays.

The control signal generation unit may generate control signals such that a control signal related to any one array of the at least two arrays has a reverse phase and time delay with respect to a control signal of another array of the at least two arrays.

The control signal generation unit may further include an equalizer adapted to compensate for sound volume variation and a frequency response according to frequencies, the sound volume variation and the frequency response caused due to differences in a time delay and a gain between the at least two arrays.

The foregoing and/or other aspects are achieved by providing a method for creating a personal sound zone, including generating a sound beam in a direction perpendicular to an arrangement of a first row array using at least three transducers of the first row array so as to create the personal sound zone in a position of a listener; and inputting control signals to the at least three transducers of the first row array, such that the control signals alternately have reverse phases with respect to the at least three transducers.

The method may further include arranging a second row array adapted to generate the sound beam using the at least three transducers so as to form an end-fire array in a direction toward the listener.

The method may further include coaxially aligning middle transducers of the at least three transducers of the first row array and the second row array.

The method may further include arranging the at least three transducers of the first row array and the second row array at uniform intervals.

Intervals among the at least three transducers of the first row array may be different from intervals among the at least three transducers of the second row array.

The inputting of the control signals alternately having reverse phases with respect to the at least three transducers of the first row array may be performed such that a phase of middle transducers among the at least three transducers is reverse to a phase of side transducers disposed on the left and the right of the middle transducers.

The method may further include inputting control signals to the at least three transducers of the second row array, such that the control signals alternately have reverse phases with respect to the at least three transducers.

A control signal related to the first row array may have a reverse phase and time delay to a control signal related to the second row array.

The control signal related to a middle transducer disposed in a middle of the first row array may have a different gain from the control signals related to transducers disposed on the left and the right of the middle transducer, and the control signals related to the left transducer and the right transducer of the middle transducer may have the same gain and the same phase as each other.

Additional aspects, features, and/or advantages of example embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
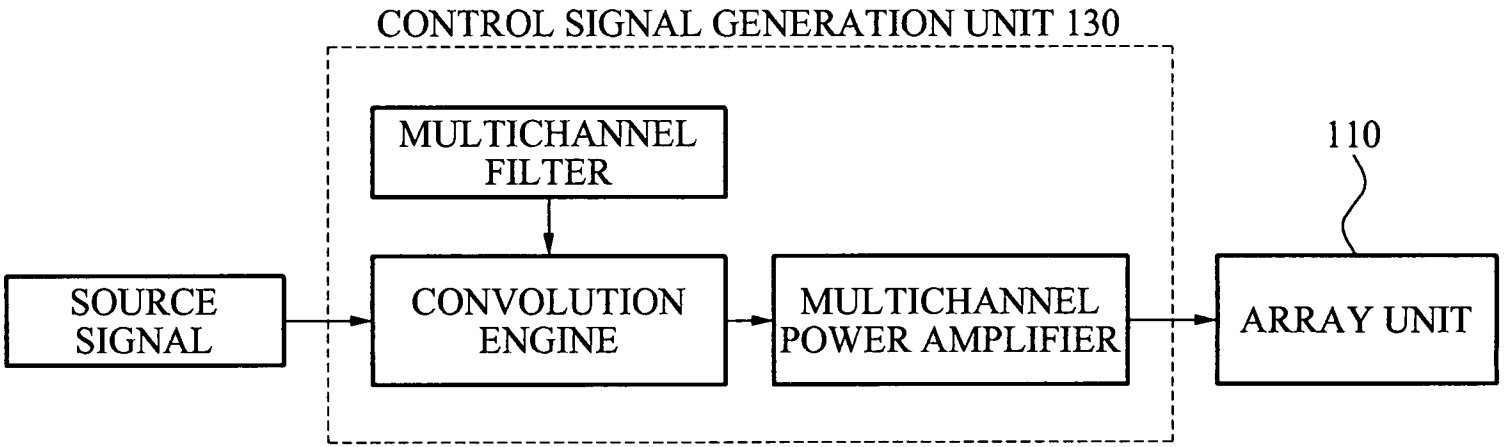
FIG. 1 illustrates a block diagram of a personal sound zone creating apparatus according to example embodiments.

Reference will now be made in detail to example embodiments, examples of which are illustrated in the accompanying drawings, wherein like reference numerals refer to the like elements throughout. Example embodiments are described below to explain the present disclosure by referring to the figures.

Limits in creating a personal sound zone in a small personal audio device such as a mobile device are introduced as follows.

First, a beam width is limited. A size of a sound zone generated by an array using a sound transducer increases in proportion to a wavelength. Therefore, the sound zone size increases in a low frequency band where a wavelength is similar to or greater than an aperture size of an array. Accordingly, the beam width with respect to the sound zone becomes physically uncontrollable.

Second, a number of integrated sound transducers constituting an array is limited. In a small personal audio device or mobile device, the number of the sound transducers is limited. That is, the sound beam needs to be generated with only a small number of sound transducers. However, when the number of the sound transducers is small, a sound pressure may not be sufficiently amplified by overlapping sound waves.

Third, control of back radiation is limited. When the sound beam is generated perpendicular to arrays in a linear array unit, a backward sound beam may be generated symmetrically to a forward sound beam as the sound wave is diffracted backward. Since diffraction occurs more easily in a small device, the backward sound beam may have an almost equal size as the forward sound beam.

Therefore, example embodiments will provide an apparatus and a method, for creating a personal sound zone, which are capable of controlling a sound beam even with a small transducer array having a relatively small number of sound transducers while preventing back radiation sound.

In addition, example embodiments will provide an apparatus and method for creating a personal sound zone, capable of securing a sufficient sound pressure difference in the overall frequency band, and focusing a sound even when an array size is extremely small in comparison with a wavelength.

FIG. 1 illustrates a block diagram of a personal sound zone creating apparatus according to example embodiments. Referring to FIG. 1, the personal sound zone creating apparatus may include an array unit 110 and a control signal generation unit 130.

The array unit 110 may include at least two arrays arranged in a sound beam generation direction. Each of the at least two arrays may include at least three transducers arranged perpendicularly to the sound beam generation direction.

In the array unit 110, middle transducers disposed in a middle of the at least three transducers, in each of the at least two arrays are coaxially arranged. Intervals among the at least three transducers in each array may be uniform.

Intervals among the at least three transducers of any one of the at least two arrays may be different from intervals among the at least three transducer of another one of the at least two arrays.

Arrangement of the at least two arrays, in the array unit 110, will be explained later with reference to FIG. 11.

The control signal generation unit 130 may generate control signals related to the at least two arrays, such that the array unit 110 may generate a sound beam perpendicularly to an arrangement direction of the at least three transducers.

The control signal generation unit 130 may generate the control signals such that a phase of the middle transducers, among the at least three transducers of the at least two arrays, is reverse to a phase of side transducers disposed on the left and the right of the middle transducers.

The control signal generation unit 130 may control signals such that, control signals related to the middle transducers, among the at least three transducers of the at least two arrays, have a different gain from control signals related to the side transducers disposed on the left and the right of the middle transducers.

The control signal generation unit 130 may generate the control signals having the same gain and the same phase with respect to transducers disposed at symmetrical positions among the at least three transducers included in each of the at least two arrays.

The control signal generation unit 130 may generate the control signals such that control signals related to any one of the at least two arrays have a reverse phase to control signals related to one of the at least two other arrays.

The control signals generated by the control signal generation unit 130 may generate a beam pattern in accordance with Equation 12 that will be described hereinafter. The beam pattern may have a sharp directivity of at least 2 forward beams by a broadside array while having directivity of 1 not to radiate a sound backward.

Figure 2A:
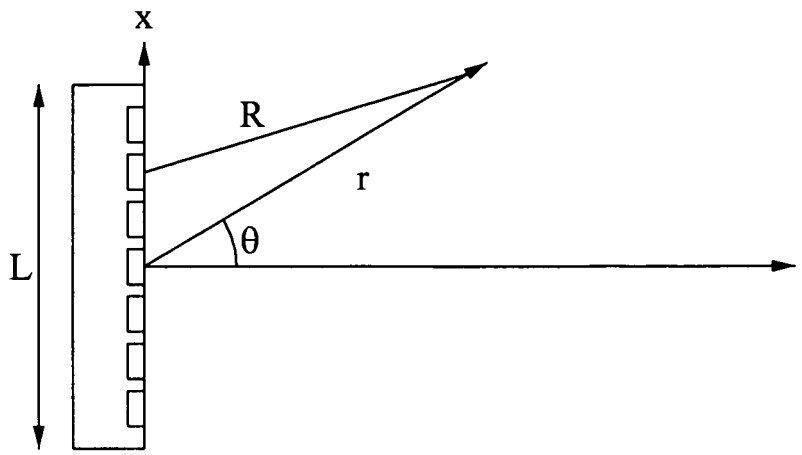
FIGS. 2A and 2B illustrate diagrams for explaining a coordinate system between an array and a listener, according to example embodiments.
Figure 2B:
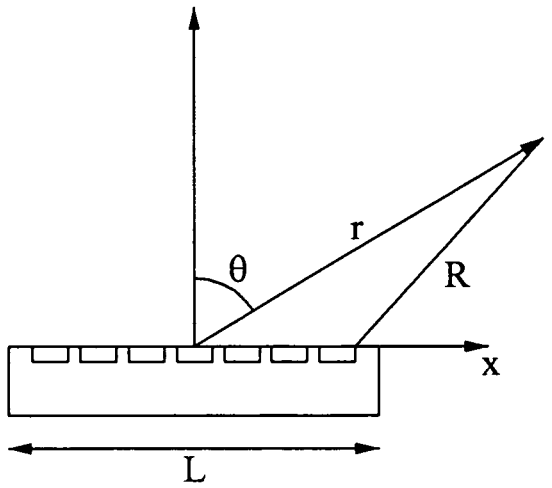
Figure 3:
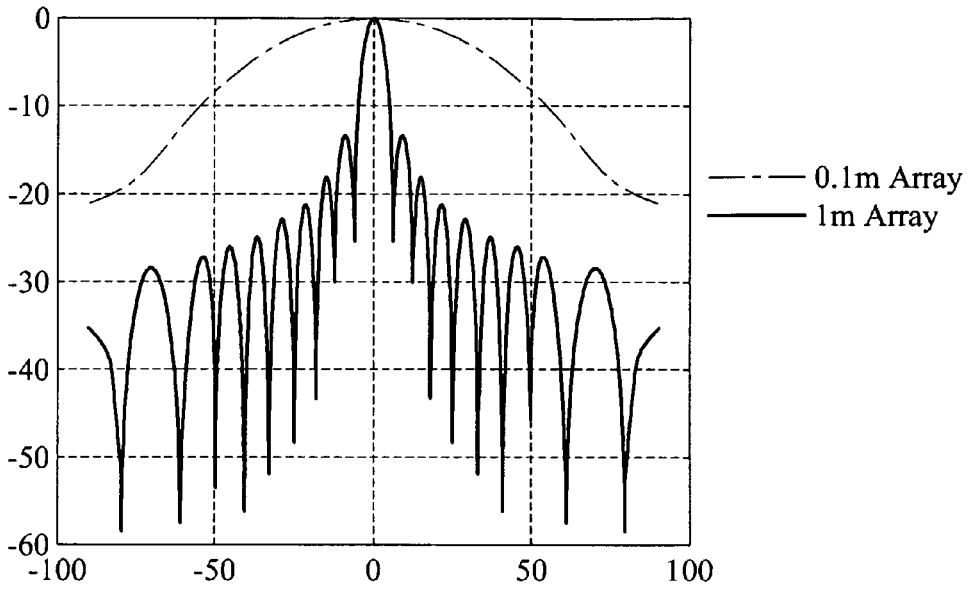
FIG. 3 illustrates a diagram showing a result of comparing beam widths per aperture size of an array being uniformly excited, according to example embodiments.

FIGS. 2A and 2B illustrate diagrams for explaining a coordinate system between an array and a listener, according to example embodiments. FIG. 3 illustrates a diagram showing a result of comparing beam widths according to aperture sizes of the array being uniformly excited, according to example embodiments FIG. 2A shows a coordinate system between the listener and a broadside array having a delay and sum structure.

Referring to FIG. 2A, it is presumed that the listener is distanced from a center of the array by a distance r in a direction of an angle θ. A symbol R denotes a distance between the listener and a sound transducer disposed at a distance x from the center of the array.

The distance R between the listener and the sound transducer may be calculated according to Equation 1 below.

$$R = \sqrt{r^2 + x^2 - 2xr\sin\theta} \approx r - x\sin\theta \quad \text{[Equation 1]}$$

wherein, r denotes the distance from the center of the array to the listener, θ denotes the angle of a position of the listener relative to the center of the array, and x denotes the distance from the center of the array to the sound transducer.

A sound pressure P(r, θ) at the distance R may be expressed by Equation 2 below.

$$p(r, \theta) = \int \frac{q(x)}{R} e^{jkR} dx \approx \frac{A}{r} e^{jkr} \int_{-L/2}^{L/2} q(x) e^{-jk\sin\theta x} dx \quad \text{[Equation 2]}$$

wherein, q(x) denotes a control signal of a transducer disposed at the distance x, k denotes a wavelength, A denotes an amplitude, and L denotes an aperture size of the array.

The sound pressure in Equation 2 may be briefly expressed by a function containing only a distance and a direction, as in Equation 3 below.

$$p(r, \theta) \propto \frac{b(\theta)}{r} \quad \text{[Equation 3]}$$

$$\text{wherein, } b(\theta) = \int_{-L/2}^{L/2} q(x) e^{-jk\sin\theta x} dx.$$

Accordingly, the sound beam may have the same pattern as a finite Fourier transformed (FFT) control signal q(x) of the transducer.

As the aperture size L of the array decreases, the FFT result has a wider distribution, accordingly increasing a width of the sound beam. For example, when all transducers are equally excited, the beam pattern may be expressed according to Equation 4 below.

$$b(\theta) = L\frac{\sin(kL\sin\theta/2)}{jkL\sin\theta/2} = -jL\,\mathrm{sinc}(kL\sin\theta/2) \quad \text{[Equation 4]}$$

That is, the beam pattern may be widened in inverse proportion to the aperture size L, according to a sinc function that has the maximum value in a vertical direction of the array.

In FIG. 2A, when a time delay is properly applied to elements of the respective arrays, the sound beam may be generated parallel to an arrangement direction of the array as shown in FIG. 2B. In the embodiment of FIG. 2B, the sound beam may not have a symmetrical form.

However, only a wide sound beam may be generated due to restriction in the aperture size as in the broadside beam. The broadside beam will be explained with reference to FIG. 3.

FIG. 3 illustrates the result of comparing beam widths according to aperture sizes of the array being uniformly excited. FIG. 3 shows the beam pattern of the array when the aperture size L is 1 m and 0.1 m.

As described with FIGS. 2A and 2B, the delay and sum structure uses the time delay to apply a spatial window to the respective sound transducers or to compensate for a difference in the distances R between the listener and the respective sound transducers. The beam pattern of the delay and sum structure may have an almost constant phase, although, the sound sources are compactly arranged. In addition, according to the FFT, the beam pattern is subordinate mostly to the aperture size in any case.

For example, in a case where a sound beam is uniformly excited according to Equation 4, when a beam width of a main lobe is defined to a position of a first null, an angle θ satisfying kL sin θ=2π, that is, the angle $$\theta = a\sin\frac{\lambda}{L}$$

becomes a half width of the main lobe.

As described above, the broadside beam refers to the sound beam extending perpendicularly to the arrangement direction of the array. In Equation 4, the sound beam satisfies b(θ)=b(π−θ), and has a symmetrical structure between a front and a back.

Figure 4:
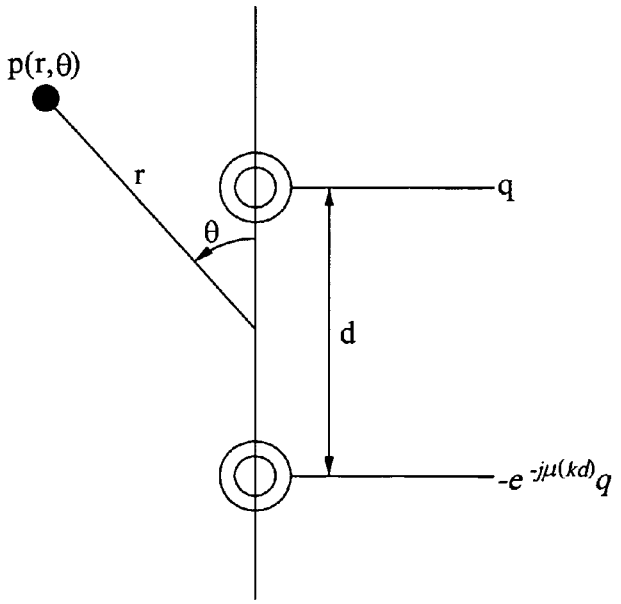
FIG. 4 illustrates a diagram explaining a problem that may be caused in a first order end-fire sound source array, according to example embodiments.
Figure 5:
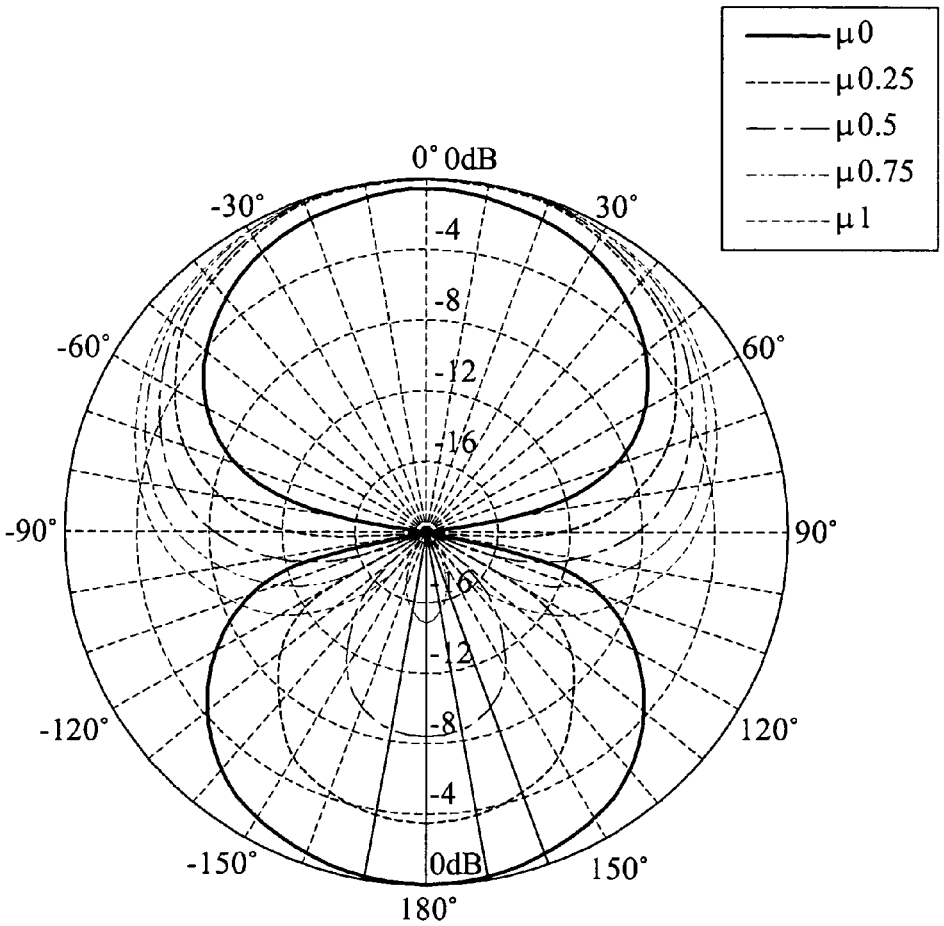
FIG. 5 illustrates a diagram showing variation of a beam pattern with respect to a parameter (μ) in the first order end-fire according to example embodiments.

FIG. 4 illustrates a diagram explaining a problem that may be caused in a first order end-fire sound source array, according to example embodiments. FIG. 5 illustrates a diagram showing variation of a beam pattern with respect to a parameter (μ) in the first order end-fire according to example embodiments.

When the delay and sum structure is applied to a compact size array, the control signals may have similar phases. However, when the phase varies abruptly among the sound transducers, higher directivity toward the listener may be obtained.

An end-fire beam pattern having directivity of 1 may be constituted by two sound sources arranged in a longitudinal direction. Control signals for controlling the sound sources may include a first signal to control a first sound source, and a second signal having a time delay and a reverse phase with respect to the first signal to control a second sound source. The control signals q for controlling the respective sound sources may be expressed by Equation 5 as follows.

$$q = [\,1 \quad -e^{j\omega t}\,] = [\,1 \quad -e^{j\mu(kd)}\,] \text{ where } \mu = c\tau/d \quad \text{[Equation 5]}$$

wherein, d denotes a distance between the sound sources.

A sound pressure p(θ) according to the signals for controlling the sound sources may be expressed by Equation 6 as follows.

In addition, the sound pressure p(θ) may indicate the directivity of 1 corresponding to cos θ.

$$p(\theta) = \frac{e^{jkr}}{r}[1 - e^{jkd(\mu+\cos\theta)}] \approx \frac{e^{-jkr}}{r}[-jkd(\mu + \cos\theta)] \quad \text{[Equation 6]}$$

According to Equation 6, a sound field may be a sum of a monopole term and a dipole term. A weight of the monopole term is varied depending on the parameter (μ), accordingly varying the directivity.

Referring to FIG. 5, the end-fire beam pattern may effectively remove back radiation by varying the parameter (μ). However, since the sound beam is generated perpendicularly to the array according to the end-fire method, the sound transducers need to be arranged in a cross-sectional direction of the device, that is, a width direction of the personal audio device.

Therefore, when the sound beam is generated by the end-fire method, the number of the arrays to be integrated is limited, accordingly limiting the directivity.

Figure 6:
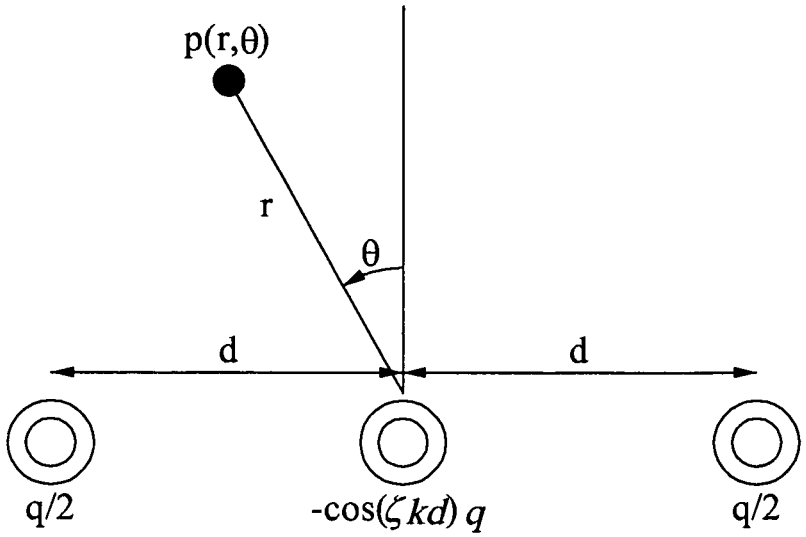
FIG. 6 illustrates a diagram explaining a method for solving a problem of a broadside sound source array, according to example embodiments.

FIG. 6 illustrates a diagram explaining a method for solving the problem of a broadside sound source array, according to example embodiments.

First, a method for generating a sound beam having a higher directivity than the delay and sum method by arranging the transducers in a broadside direction will be explained.

When a broadside sound beam is generated using three sound sources arranged as shown in FIG. 6, the control signals q input with reverse phases for neighboring transducers may be expressed by Equation 7 as follows.

$$q = [\,1/2 \quad -\cos(\zeta kd) \quad 1/2\,]\ \left(0 < \zeta kd << \frac{\pi}{2}\right) \qquad \text{[Equation 7]}$$

In addition, the sound pressure p(θ) generated by the control signals q may be expressed by Equation 8 as follows.

$$p(\theta) = \frac{e^{-jkr}}{r}[\cos(kd\sin\theta) + \cos(\zeta kd)] \approx \frac{e^{-jkr}}{r}\frac{(kd)^2}{2}[\zeta^2 - \sin^2\theta] \qquad \text{[Equation 8]}$$

In Equation 8, the sound pressure p(θ) has a directivity of 2 according to the angle θ. For example, when ζ=1, the sound pressure p(θ) may have the directivity of $\cos^2\theta$.

The above-described effect of the broadside sound source array may also be obtained by using at least three sound sources. Although, an increase in a number of the sound sources is undesirable, such a case may be included in various example embodiments.

When the number of used sound sources increases, the control signals q may be expressed by Equation 9 as follows.

$$q' = q * h \qquad \text{[Equation 9]}$$

wherein, h denotes a certain window function. When the window function h having an n-number of coefficients is convoluted with the control signals q, a general equation of a control function with respect to an n+2 number of sound sources may be obtained.

For example, a control function q' in a case of using a uniform window having 2 coefficients may be expressed by Equation 10 as follows.

$$\begin{aligned} q' &= q * h \\ &= [\,1/2 \quad -\cos(\zeta kd) \quad 1/2\,] * [\,1 \quad 1\,] \\ &= [\,1/2 \quad 1/2 - \cos(\zeta kd) \quad 1/2 - \cos(\zeta kd) \quad 1/2\,] \end{aligned} \qquad \text{[Equation 10]}$$

According to the example embodiments, the array is arranged perpendicularly to a direction of the listener, and the sound pressure is generated such that the phases are reverse. As a result, the directivity may be increased.

Figure 7:
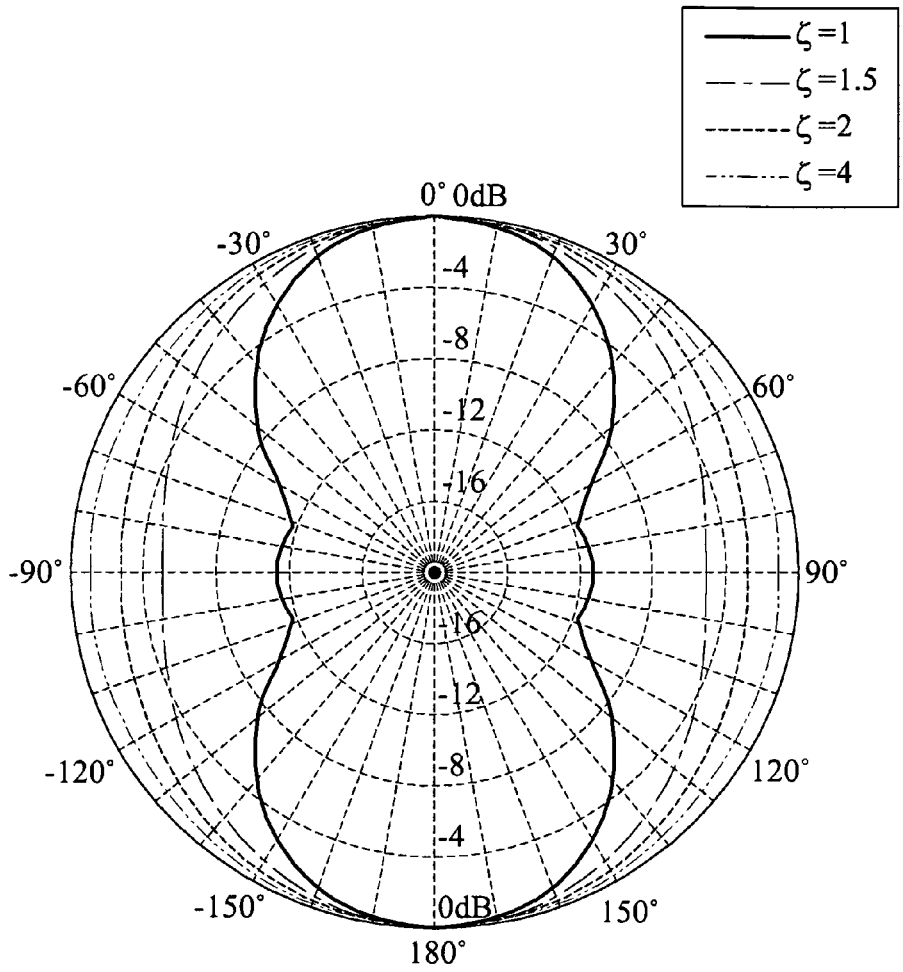
FIG. 7 illustrates a diagram for explaining variation of a broadside beam pattern according to variation of a parameter, according to example embodiments.

FIG. 7 illustrates a diagram for explaining variation of a broadside beam pattern according to variation of a parameter, according to example embodiments.

Referring to FIG. 7, directivity of a sound beam pattern increases according to variation of a parameter ζ. The directivity is maximized near ζ=1.

The directivity may be highly increased in a horizontal direction by the method explained with reference to FIG. 6. However, in this case, the sound beam pattern becomes symmetrical (P(θ)=p(π−θ)) between the front and the back due to characteristics of the broadside array.

Therefore, the example embodiments may effectively remove the back radiation sound by combining characteristics of the end-fire array and the broadside array, while improving the directivity to the front.

Figure 8:
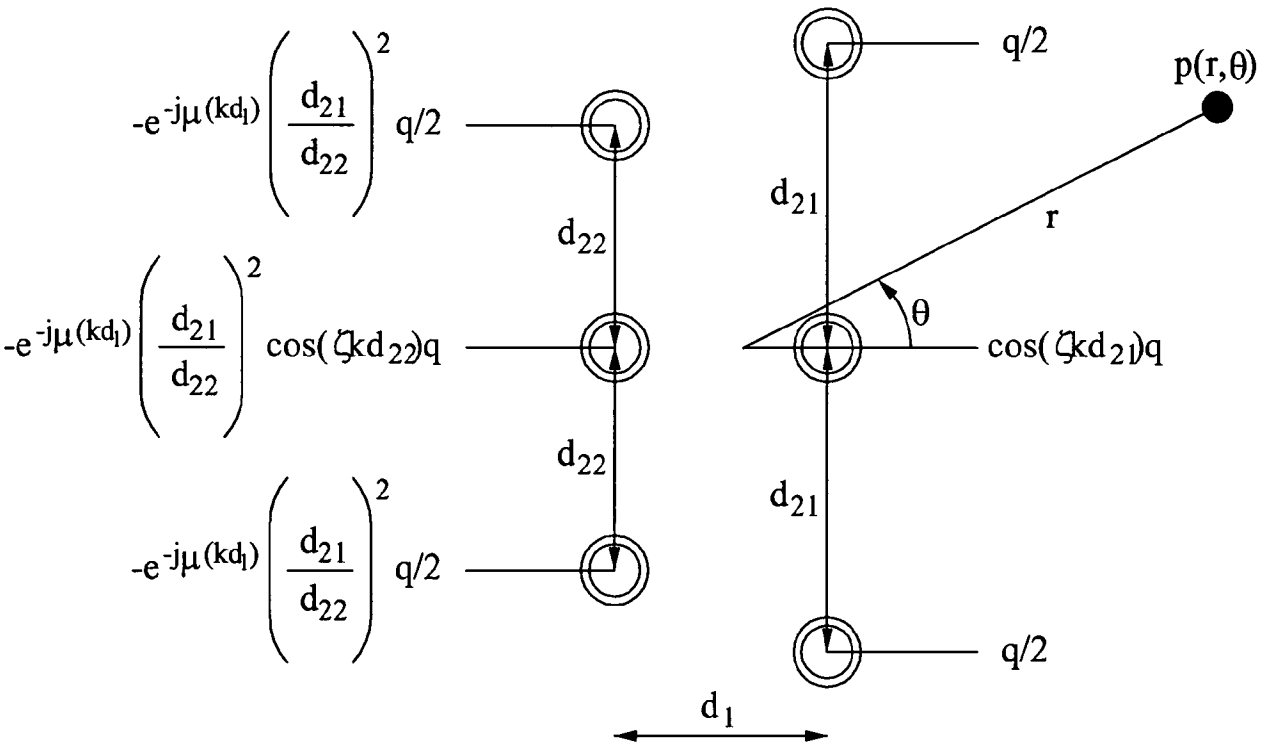
FIG. 8 illustrates a diagram showing an array arrangement and control signals according to example embodiments.

FIG. 8 illustrates a diagram showing an array arrangement and control signals according to example embodiments. As described above, the end-fire array is capable of stably achieving higher directivity. However, the end-fire array is hard to configure in a personal sound device such as a mobile phone, a smart phone, an MP3 player, and the like, because the array needs to be arranged toward the listener.

When the broadside array is used, the array is conveniently arranged. However, control of a sound field is difficult, since the sound field is radiated both to the listener and to the back.

To solve such difficulties, sound transducers may be arranged by combining the broadside array and the end-fire array as shown in FIG. 8.

Referring to FIG. 8, an array to generate a broadside beam is structured using three transducers arranged perpendicularly to the direction to the listener. Simultaneously, an end-fire array may be structured toward the listener by combining at least two arrays.

In the array structure, as shown above, in FIG. 8, control signals q may be expressed by Equation 11 as follows.

$$q = [\tfrac{1}{2} - \cos(\zeta \cdot kd_{21})\tfrac{1}{2};\ -e^{j\mu(kd_1)}(d_{21}/d_{22})^2[\tfrac{1}{2} - \cos(\zeta \cdot kd_{22})\tfrac{1}{2}]] \qquad \text{[Equation 11]}$$

In addition, a sound pressure p(θ) generated by Equation 11 may be expressed by multiplication of two sound beam patterns as in Equation 12 below.

$$p(\theta) \approx \frac{jkd_1(kd_{21})^2}{2}\frac{e^{-jkr}}{r}(\zeta^2 - \sin^2\theta)(\mu + \cos\theta) \qquad \text{[Equation 12]}$$

Figure 9:
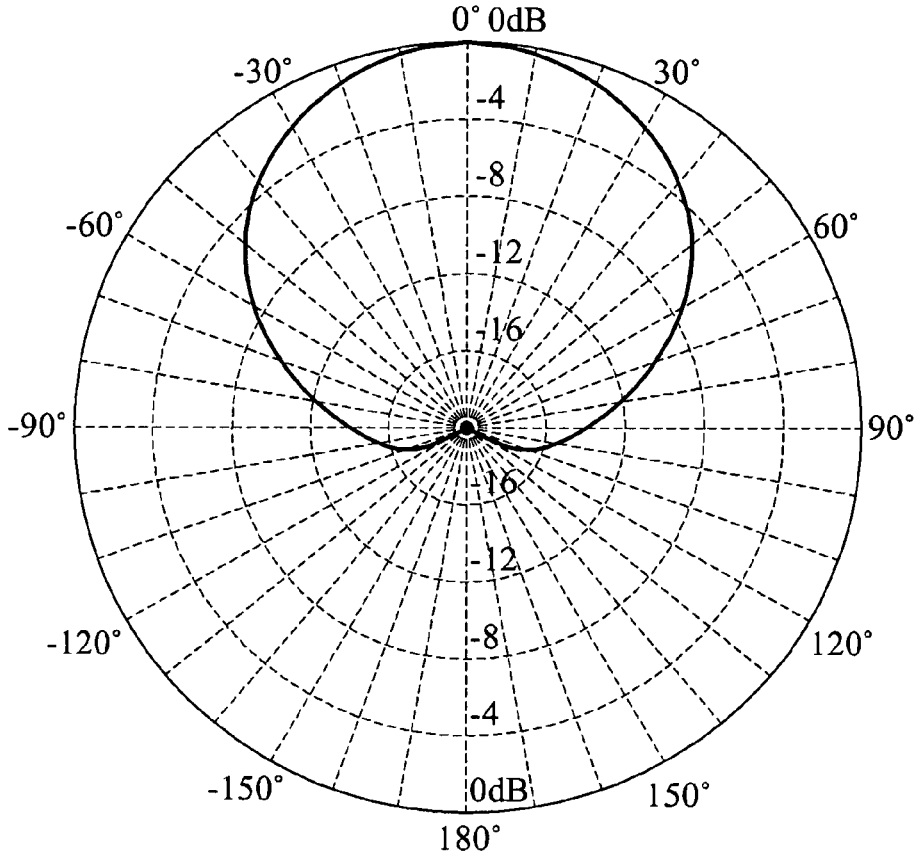
FIG. 9 illustrates a diagram of a beam pattern generated by a personal sound zone creating method according to example embodiments.

The sound beam pattern according to Equation 12 may not radiate a sound to the back by generating a directivity of 1 backward, while generating a sharp directivity of at least 2 to the front by the broadside array. FIG. 9 illustrates a diagram of an exemplary beam pattern generated by the sound source array and the signal processing method of FIG. 8.

Figure 10:
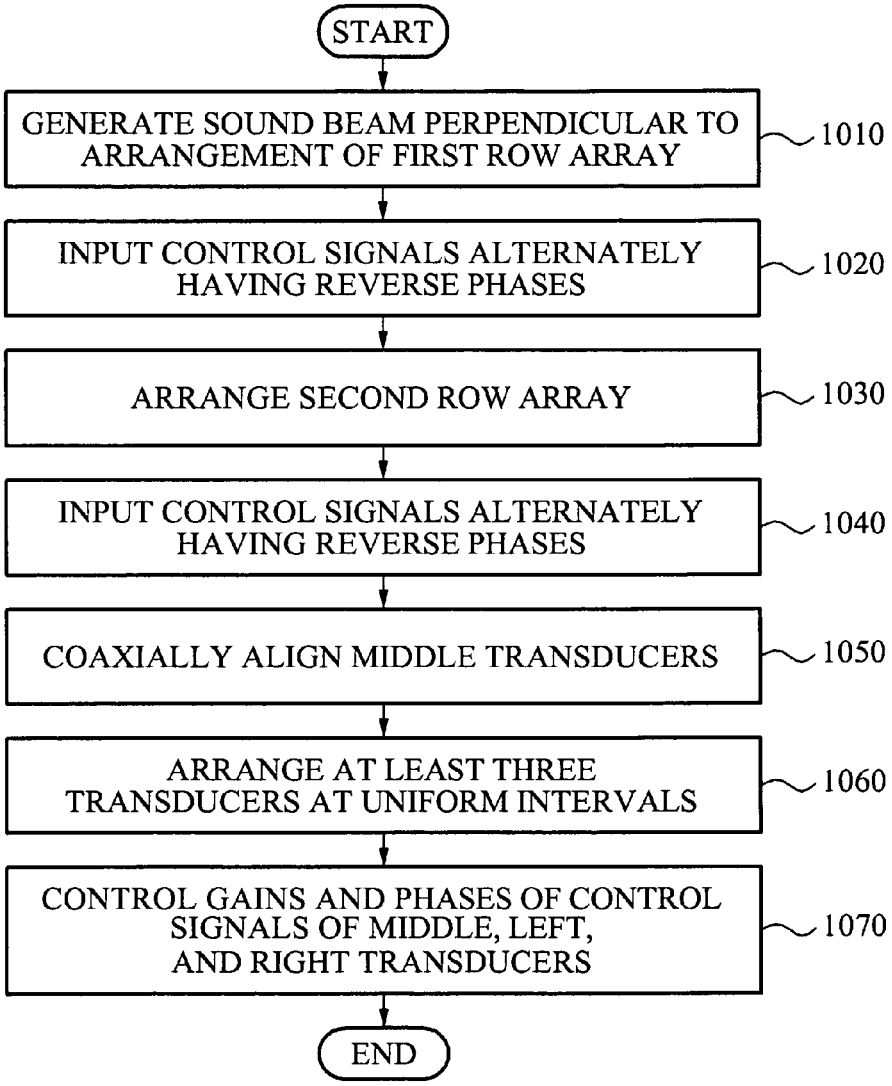
FIG. 10 illustrates a flowchart of a personal sound zone creating method according to example embodiments.

FIG. 10 illustrates a flowchart of a personal sound zone creating method according to example embodiments.

Referring to FIG. 10, a personal sound zone creating apparatus (hereinafter, referred to briefly as 'creating apparatus') may generate a sound beam perpendicularly to an arrangement direction of a first row array, using at least three transducers included in the first row array, so as to form a personal sound zone in a position of a listener, in operation 1010.

The creating apparatus may input control signals alternately having reverse phases, respectively to the at least three transducers of the first row array, in operation 1020.

In operation 1020, the creating apparatus may input the control signals in which a phase of a middle transducer of the at least three transducers of the first row array is reverse to a phase of side transducers disposed on the left and the right of the middle transducers.

The creating apparatus may arrange a second array adapted to generate a sound beam using at least three transducers, so as to form an end-fire array in a direction toward the listener, in operation 1030.

A method for arranging the first row array and the second row array will be described with reference to FIG. 11.

In addition, the creating apparatus may input the control signals alternately having reverse phases respectively to the at least three transducers of the second row array, in operation 1040.

The creating apparatus may coaxially align middle transducers of the at least three transducers of each of the first row array and the second row array, in operation 1050.

The creating apparatus may arrange the at least three transducers of each of the first row array and the second row array at uniform intervals, in operation 1060.

Specifically, intervals of the at least three transducers of the first row array may be different from intervals of the at least three transducers of the second row intervals.

Additionally, the control signals for the first row array may have a reverse phase and time delay with respect to the control signals for the second row array.

The control signal for the middle transducer of the first row array may have a different gain from the control signals for the side transducers disposed on the left and the right of the middle control signal. The control signals for the side signals may have the same gain and the same phase as each other, in operation 1070.

FIG. 11 illustrates a diagram showing an arrangement of an array unit according to example embodiments. FIG. 12 illustrates a diagram showing an array according to example embodiments, being mounted to a personal audio device Referring to FIG. 11, the array unit may generate a sound beam having directivity according to input of a control signal including multi-channels. The array unit may include at least two arrays, each of which may include at least three transducers.

Figure 11A:
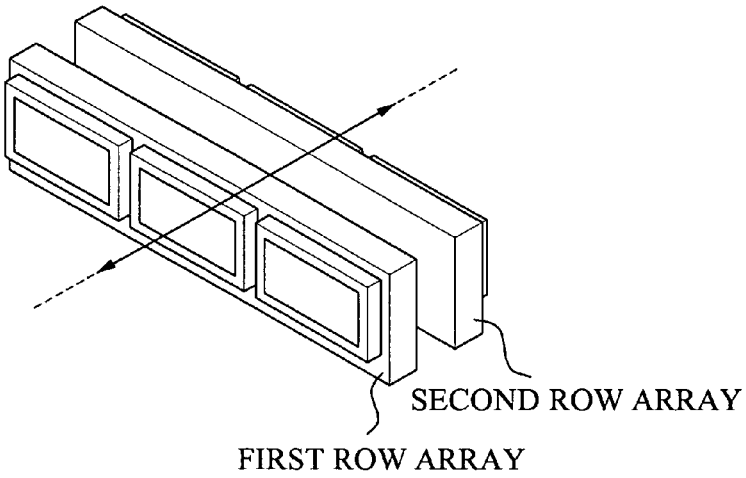
FIG. 11 illustrates a diagram of an array unit according to example embodiments.
Figure 11B:
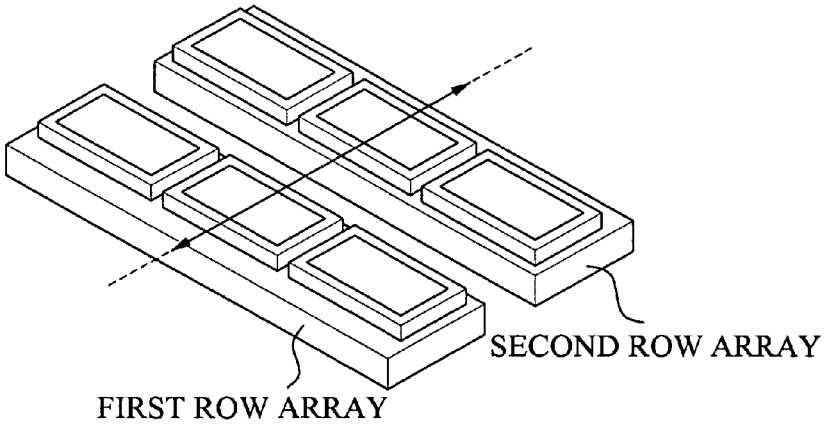
Figure 11C:
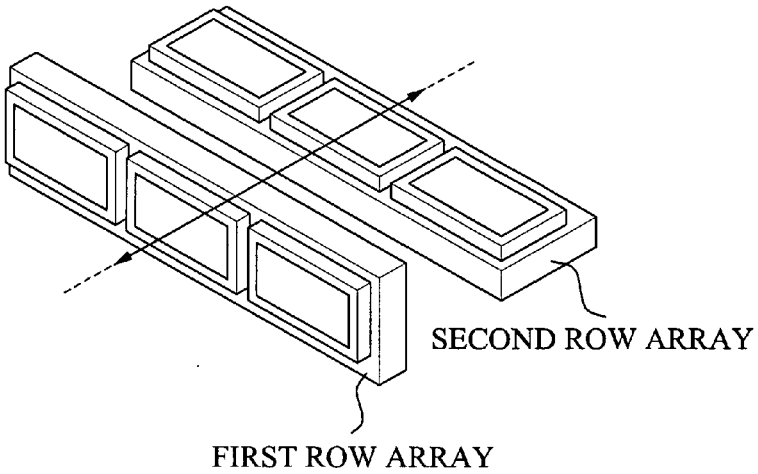
Figure 11D:
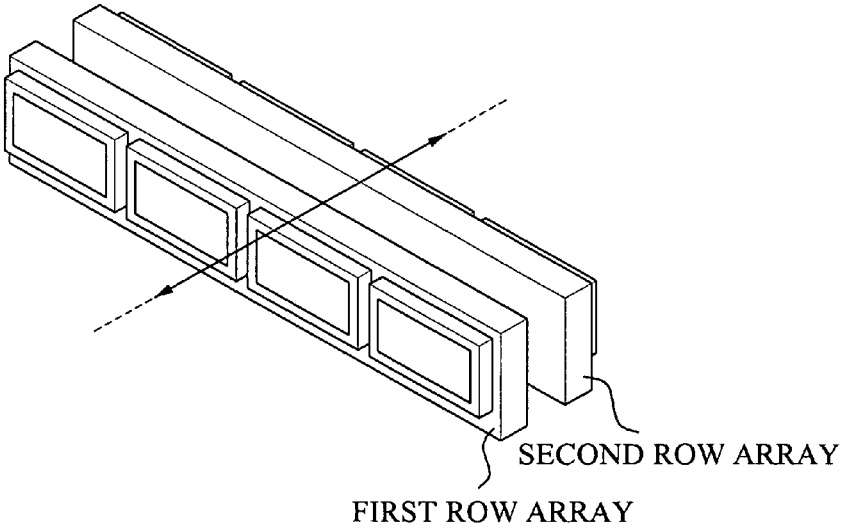
Figure 12:
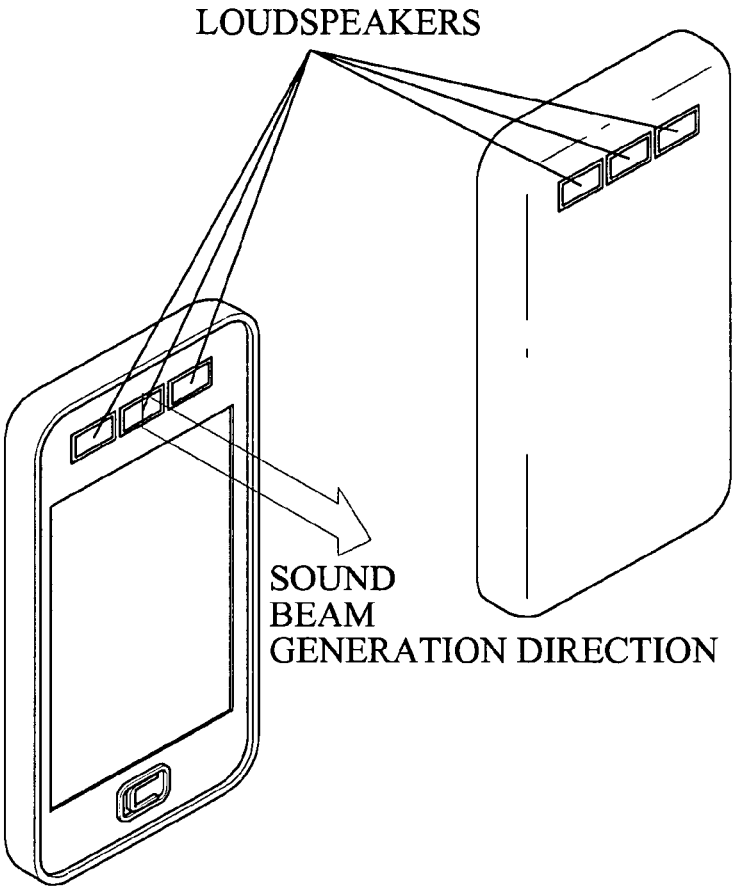
FIG. 12 illustrates a diagram showing an array according to example embodiments, being mounted to a personal audio device.

The array unit may be configured in a manner that a front array disposed on a front side and a back array disposed on a back side are directed opposite from each other as shown in FIG. 11A. Alternatively, the arrays may be arranged coplanarly as shown in FIG. 11B, or arranged to substantially form a right angle as shown in FIG. 11C. Also, the front array and the back array may each include four sound transducers as shown in FIG. 11D.

That is, the array unit may be configured in any manner as long as the respective arrays constituting the array unit are arranged in a direction for generating the sound beam and the at least three transducers of each array are perpendicular to the sound beam generation direction. Also, the middle transducers among the at least three transducers of the respective arrays need to be coaxially aligned. In addition, the control signals as described with reference to FIG. 1 are to be applied to the at least three transducers of each array.

Referring to FIG. 12, directivity in a horizontal direction may be enhanced by a broadside array configured to generate a sound beam perpendicularly to the arrangement direction of one array, that is, the arrangement of the at least three transducers, in the personal audio device. Also, back radiation may be controlled by forming the end-fire array by arranging at least two arrays in the sound beam generation direction on the front and the back of the personal audio device.

Figure 13:
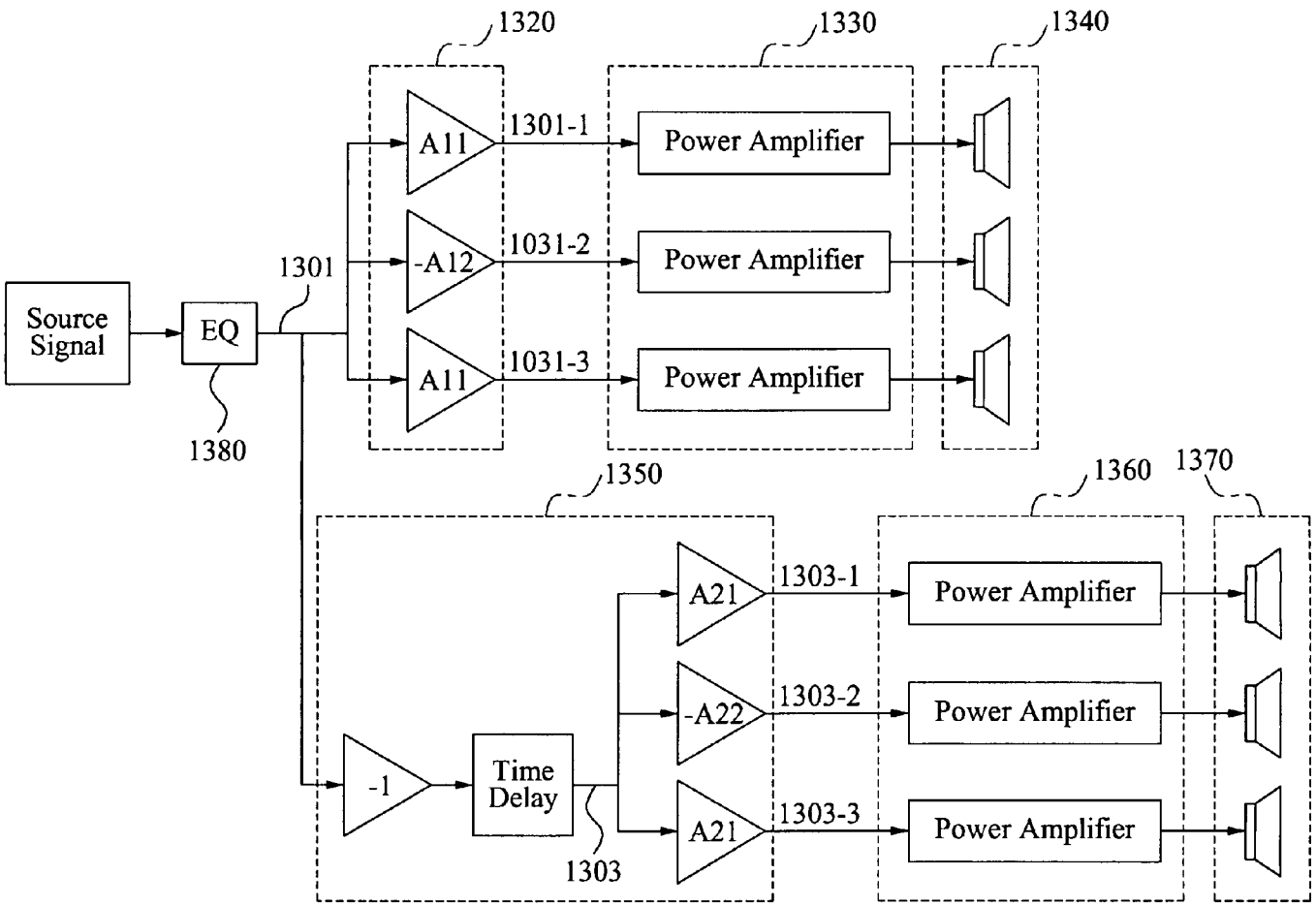
FIG. 13 illustrates a diagram showing signal processing procedures in a personal sound zone creating apparatus according to example embodiments.

FIG. 13 illustrates a diagram showing signal processing procedures in a personal sound zone creating apparatus according to example embodiments.

Referring to FIG. 13, the personal sound zone creating apparatus may include a control signal generation unit and an array unit. The control signal generation unit may include multichannel filters 1320 and 1350, and power amplifiers 1330 and 1360. The array unit may include a first row array 1340 and a second row array 1370.

The control signal generation unit may further include an equalizer 1380 adapted to compensate for sound volume variation and a frequency response according to frequencies, the sound volume variation and the frequency response caused due to differences in a time delay and a gain between the at least two arrays.

The control signal generation unit may generate control signals appropriate for the arrangement of the array according to the example embodiments. The control signals may have characteristics as follows.

The control signals for generating high directivity may be divided into control signals 1301-1, 1301-2, and 1301-3, for exiting the first row array 1340, and control signals 1303-1, 1303-2, and 1303-3, for exciting the second row array 1370.

The respective control signals may include signals of three channels for generating the sound beam perpendicularly to the arrangement direction of at least three transducers by controlling the at least three transducers constituting each row of the arrays.

A signal A12 for controlling a middle transducer of the first row array 1340 may have a reverse phase, that is, the opposite sign, with respect to signals A11 for controlling the other transducers, as referenced in Equation 7.

Here, the signals A11, for controlling the other transducers disposed on the left and the right of the middle transducer of the first row array 1340, may have the same sign.

In the same manner as in the first row array 1340, a signal A22, for controlling a middle transducer of the second row array 1370, may have a reverse phase, that is, the opposite sign, and different gains or magnitudes with respect to signals A21 for controlling the other transducers.

The first row array 1340 may be disposed on a front side of the device whereas the second row array 1370 may be disposed on a back side.

The control signal generation unit may generate the control signals such that control signals 1301 for the first row array 1340 have the reverse phase, that is, the opposite sign, to control signals 1303 for the second row array 1370.

Also, the control signal generation unit may generate the control signals such that the control signal 1301, for the first row array 1340, has a specific time delay with respect to the control signal 1303 for the second row array 1370, as shown in Equation 5.

Thus, since the input control signals have reverse phases with respect to the at least three transducers included in the array, a sound may be effectively focused on a sound zone even with a small-size array.

In addition, since the sound beam generated is perpendicular to the arrangement direction of the array, the number of transducers necessary in a thickness direction may be reduced. As a result, the personal audio device formed may be slimmer.

Moreover, since the end-fire array is formed toward the listener, back radiation of the sound is effectively reduced while directivity is increased toward the listener.

The methods according to the above-described example embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The media may be transfer media such as optical lines, metal lines, or waveguides including a carrier wave for transmitting a signal designating the program command and the data construction. Examples of program instructions include both machine code, such as produced by a compiler, and files containing higher level code that may be executed by the computer using an interpreter. The described hardware devices may be configured to act as one or more software modules in order to perform the operations of the above-described example embodiments, or vice versa.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. An apparatus for creating a personal sound zone, the apparatus comprising:

an array unit configured to comprise a first array arranged in a direction of a first sound beam and a second array arranged in a direction of a second sound beam, the first and second array each comprising at least three transducers arranged perpendicularly to the direction of the sound beam; and a control signal generation unit configured to generate control signals for the first and second array such that each of the first and second array generates the sound beam perpendicularly to the at least three transducers, wherein when the control signal generation unit generates control signals such that a control signal related to the first array has a reverse phase and time delay with respect to a control signal of the second array, the array unit outputs an output sound beam to a direction of the second array.

2. The apparatus of claim 1, wherein middle transducers among the at least three transducers of the first and second array are coaxially aligned, and intervals among the at least three transducers of the at least two arrays are uniform.

3. The apparatus of claim 1, wherein intervals among the at least three transducers of any one of the at least two arrays are different from intervals among the at least three transducers of another array.

4. The apparatus of claim 1, wherein the control signal generation unit generates control signals in which a phase of middle transducers among the at least three transducers of the first and second array is reverse to a phase of side transducers disposed on the left and the right of the middle transducers.

5. The apparatus of claim 1, wherein the control signal generation unit generates control signals such that control signals related to middle transducers, among the at least three transducers of the first and second array, have a different gain from control signals related to side transducers disposed on the left and the right of the middle transducers.

6. The apparatus of claim 1, wherein the control signal generation unit generates control signals having the same gain and the same phase with respect to transducers disposed at symmetrical positions, among the at least three transducers included in, each of the first and second array.

7. The apparatus of claim 1, wherein the control signal generation unit generates control signals such that a control signal related to any one array of the first and second array has a reverse phase and time delay with respect to a control signal of another array of the first and second array.

8. The apparatus of claim 1, wherein the control signal generation unit further comprises an equalizer adapted to compensate for sound volume variation and a frequency response according to frequencies, the sound volume variation and the frequency response caused due to differences in a time delay and a gain between the first and second array.

9. A method for creating a personal sound zone, comprising:

generating a first sound beam of a first row array using at least three transducers of the first row array arranged perpendicularly to a direction of the first sound beam in response to first control signals, the first row array being arranged in the direction of the first sound beam;

generating a second sound beam of a second row array using at least three transducers of the second row array arranged perpendicularly to a direction of the second sound beam in response to second control signals, the second row array being arranged in the direction of the second sound beam; and outputting an output sound beam based on the first and second sound beam to a direction of the second row array when the first control signals have a reverse phase and time delay to the second control signals.

10. The method of claim 9, wherein middle transducers of the at least three transducers of the first row array and the second row array are coaxially aligned.

11. The method of claim 9, wherein intervals among the at least three transducers of the first row array and the second row array are uniform.

12. The method of claim 11, wherein intervals among the at least three transducers of the first row array are different from intervals among the at least three transducers of the second row array.

13. The method of claim 9, wherein the first control signals alternately having reverse phases with respect to the at least three transducers of the first row array are inputted such that a phase of middle transducers among the at least three transducers is reverse to a phase of side transducers disposed on the left and the right of the middle transducers.

14. The method of claim 9, wherein the second control signals alternately have reverse phases with respect to the at least three transducers.

15. The method of claim 9, wherein a control signal related to a middle transducer disposed in a middle of the first row array has a different gain from control signals related to transducers disposed on the left and the right of the middle transducer, and the control signals related to the left transducer and the right transducer of the middle transducer have the same gain and the same phase as each other.

16. A non-transitory computer readable recording medium storing a program to cause a computer to implement the method of claim 9.

* * * * *